United States Patent [19]

Wright et al.

[11] 4,322,281

[45] Mar. 30, 1982

[54] METHOD FOR CONTROLLING FOAMING WITHIN GAS-LIQUID SEPARATION AREA

[75] Inventors: David B. Wright; Sanders H. Moore, both of Cleveland, Tenn.; Morton S. Kircher, Clearwater, Fla.

[73] Assignee: Olin Corporation, New Haven, Conn.

[21] Appl. No.: 226,979

[22] Filed: Jan. 21, 1981

Related U.S. Application Data

[63] Continuation-in-part of Ser. No. 213,800, Dec. 8, 1980.

[51] Int. Cl.[3] ..... C25B 9/00

[52] U.S. Cl. ..... 204/237; 204/257; 204/263; 204/266; 204/258; 204/98; 204/128

[58] Field of Search ..... 204/98, 128, 257, 258, 204/263, 266, 237

[56] References Cited

U.S. PATENT DOCUMENTS

| | | | |
|---|---|---|---|
| 3,855,091 | 12/1974 | Piester | 204/128 |
| 3,898,149 | 8/1975 | Kircher et al. | 204/252 |
| 3,928,150 | 12/1975 | Rahn et al. | 204/98 |
| 3,928,165 | 12/1975 | Piester | 204/278 |
| 4,076,603 | 2/1978 | Andersen | 204/98 |
| 4,138,295 | 2/1979 | DeNora et al. | 204/98 |
| 4,174,266 | 11/1979 | Jeffery | 204/98 |
| 4,212,714 | 7/1980 | Coker et al. | 204/98 |
| 4,217,199 | 8/1980 | Cunningham | 204/256 |

FOREIGN PATENT DOCUMENTS

| | | | |
|---|---|---|---|
| 900645 | 7/1949 | Fed. Rep. of Germany | 204/258 |

*Primary Examiner*—R. L. Andrews

*Attorney, Agent, or Firm*—Ralph D'Alessandro; Donald F. Clements; Thomas P. O'Day

[57] ABSTRACT

A method of varying the flow in a flow conduit from both the anolyte disengager and the catholyte disengager to each appropriately corresponding electrode is provided to selectively vary the flow rate of electrolyte fluids through the disengagers to the appropriate electrodes to thereby control the level of foaming of the electrolyte fluids within the disengagers to prevent the blowover of foam during the separation of entrained gas from the electrolyte fluids therein.

12 Claims, 4 Drawing Figures

FOAM DEPTH IN DISENGAGER AS FUNCTION OF FLOW RATE OF ANOLYTE RETURN

METHOD FOR CONTROLLING FOAMING WITHIN GAS-LIQUID SEPARATION AREA

BACKGROUND OF THE INVENTION

This application is a continuation-in-part of application Ser. No. 213,800, filed Dec. 8, 1980.

The present invention relates generally to a method utilized in an electrolytic cell for the production of chlorine, alkali metal hydroxides or other caustics and hydrogen, wherein each electrolytic cell unit has at least one central electrode assembly sandwiched between at least two end electrode assemblies to form a closed system for the efficient utilization of the materials circulated therethrough. More particularly, the present invention relates to the method employing an improved electrolyte recirculation system within a filter press membrane cell wherein restrictor apparatus is utilized in the feed line to each electrode to selectively control the recirculation rate of the electrolyte to thereby control the level of electrolyte/gas foaming that occurs in the disengager.

As products of the electrolytic process, chlorine and caustic have become large volume commodities as basic chemicals which are an integral part of Western civilization as it is known today. The overwhelming amounts of these chemicals are produced electrolytically from aqueous solutions of alkali metal chlorides. Cells which have traditionally produced these chemicals have come to be known commonly as chlor-alkali cells. The chlor-alkali cells generally were of two principal types, the deposited asbestos diaphragm-type electrolytic cell or the flowing mercury cathode type. Comparatively recent technological advances, such as the development of the dimensionally stable anode and various coating compositions, have permitted the gaps between the electrodes to be substantially decreased and thereby dramatically increased the energy efficiency in the operation of these energy-intensive units. The development of a hydraulically impermeable membrane has promoted the advent of filter press membrane electrolytic cells which produce a relatively uncontaminated caustic product, obviating the need for caustic purification and concentration processing steps. The use of a hydraulically impermeable planar membrane has been most common in bipolar filter press membrane electrolytic cells. However, advances continue to be made in the development of monopolar filter press membrane cells.

Gas separators or disengagers have been utilized, especially in monopolar filter press membrane cells, to permit the chlorine gas to separate from the anolyte fluid during the electrolytic process. The anolyte disengager typically includes a layer of liquid anolyte along its bottom portion, a layer of foam within which various gases such as $O_2$, $CO_2$ and chlorine are present, and the separated chlorine and other gases in the top layer. Naturally, in a process designed to produce chlorine gas, efficiency of the apparatus is gauged by its ability to have the chlorine gas separate or rise up through and out of the anolyte fluid. It has been determined in testing that excessive amounts of foam in the anolyte disengager can cause carryover of foam into the gas flow lines leading to undesirable pressure surges during operation, while too little foam in the disengager may indicate that excessive chlorine gas separation is taking place within the anode chamber which may be damaging to the membranes because of the high concentration of chlorine gas within the anode and detrimental to the energy efficiency of the cell.

To control the production of gas during operation, electrolyte is circulated through a cell between the electrodes and the disengagers. It has been found that the greater the rate of recirculation of electrolyte, the greater is the amount of foam that is formed within the anolyte disengager. A similar relationship has been found to exist in the catholyte disengager between the level of foaming and the recirculation rate of the make-up water and electrolyte. By controlling the rate of flow of the electrolyte during operation, optimum efficiency of the cell can be obtained.

Under certain conditions it is desirable to be able to vary the electrolyte flow rate between the anolyte disengager and the anodes to control the level of foam build-up within the disengager. During the start-up of the cell, a period which can last from initial start-up to 12 hours, the amount of electrolyte being recirculated needs to be limited because of the high level of foaming that occurs in the disengager. Gradually, as the cell stabilizes, the electrolyte flow rate could possibly be increased. Also, variations in the current level which the cell receives during operation in response to increased or decreased production demands for caustic or chlorine, or power outages can require a change in the electrolyte flow rate during recirculation to maintain the foam build-up and chlorine gas separation at the optimum levels in the anolyte disengager. Varying levels of carbonate in the feed brine that is used as the electrolyte can substantially affect the amount of foam that is produced in the anolyte disengager. This occurs because the process generates $CO_2$ gas which bubbles up through electrodes with the other gases which are produced to contribute to the foam layer in the disengager. Further, any attempt to optimize the disengaging rate of the gas in the anolyte disengager from the anolyte fluid can require variation in the flow rate of the recirculating electrolyte fluid during operation.

Higher than normal levels of foaming can occur in the catholyte disengager during the start-up of a cell lasting from initial start-up for as long as 4 to 6 hours. Similarly to the anolyte disengager, as the cell gradually stabilizes, the electrolyte and make-up water recirculation rate could possibly be increased to optimize the rate of gas separation within the catholyte disengager.

The size of the anolyte and catholyte disengagers are a direct function of the foaming levels and amount of gas separation desired within each disengager. Where excessive foaming continually occurs, larger sized disengagers may be required. An alternative approach providing satisfactory performance can be achieved by varying the electrolyte flow rate through the cell. In fact, it is entirely possible that by varying the flow rate, smaller sized disengagers could be utilized. This is especially attractive for anolyte disengagers where the construction involves costly materials, such as titanium.

The foregoing problems are solved in the method and the design of the apparatus comprising the present invention by providing a variable flow restrictor in the flow conduit from each gas-liquid disengager to each electrode frame to selectively vary the flow rate of the electrolyte fluid being recycled through the disengagers to each electrode to thereby control the level of foaming in the electrolyte fluid within the disengagers and thereby optimize the amount of gas separated out within the disengagers.

SUMMARY OF THE INVENTION

It is a principal object of the present invention to provide in an electrolytic cell in general and in an electrolytic filter press membrane cell specifically a method of utilizing a variable flow restrictor in a flow conduit connecting the anolyte or catholyte disengager and each anode or cathode, respectively, to selectively control the recirculation rate of the electrolyte within the cell.

It is another object of the present invention to prevent a blow-over of foam from either the anolyte or catholyte disengager caused by electrolyte foaming due to excessively high recirculation rates during operation.

It is a feature of the method of the present invention that a restrictor placed within the flow conduit between the anolyte or catholyte disengager and each anode or cathode, respectively, be able to selectively adjust the electrolyte recirculation flow rate.

It is an advantage of the present invention that the variable flow restrictor is a simple and relatively inexpensive device easily utilizable in the method employed in the filter press membrane cell of the present design.

It is another advantage of the method of the present invention that the separation rate of chlorine gas within the anolyte disengager from the electrolyte fluid and the hydrogen gas from the electrolyte fluid within the catholyte disengager can be optimized despite the occurrence of conditions during operation which would normally decrease the cell's efficiency.

These and other objects, features, and advantages are obtained in an electrolytic cell in general and in an electrolytic filter press membrane cell specifically having electrolyte fluid circulated through anode and cathode frames, wherein the anolyte disengager and the catholyte disengager have at least a first flow conduit and a second flow conduit in fluid flow communication with each anode and cathode, respectively, by providing a method of employing variable flow restrictor within the first flow conduit from the appropriate disengager to each electrode frame to selectively vary the flow rate of electrolyte through the anolyte disengager and the catholyte disengager to thereby control the level of foaming in both the anolyte within the anolyte disengager and the catholyte within the catholyte disengager to optimize the amount of gas separated out.

DETAILED DESCRIPTION OF THE PREFERRED EMBODIMENT

Figure 1:
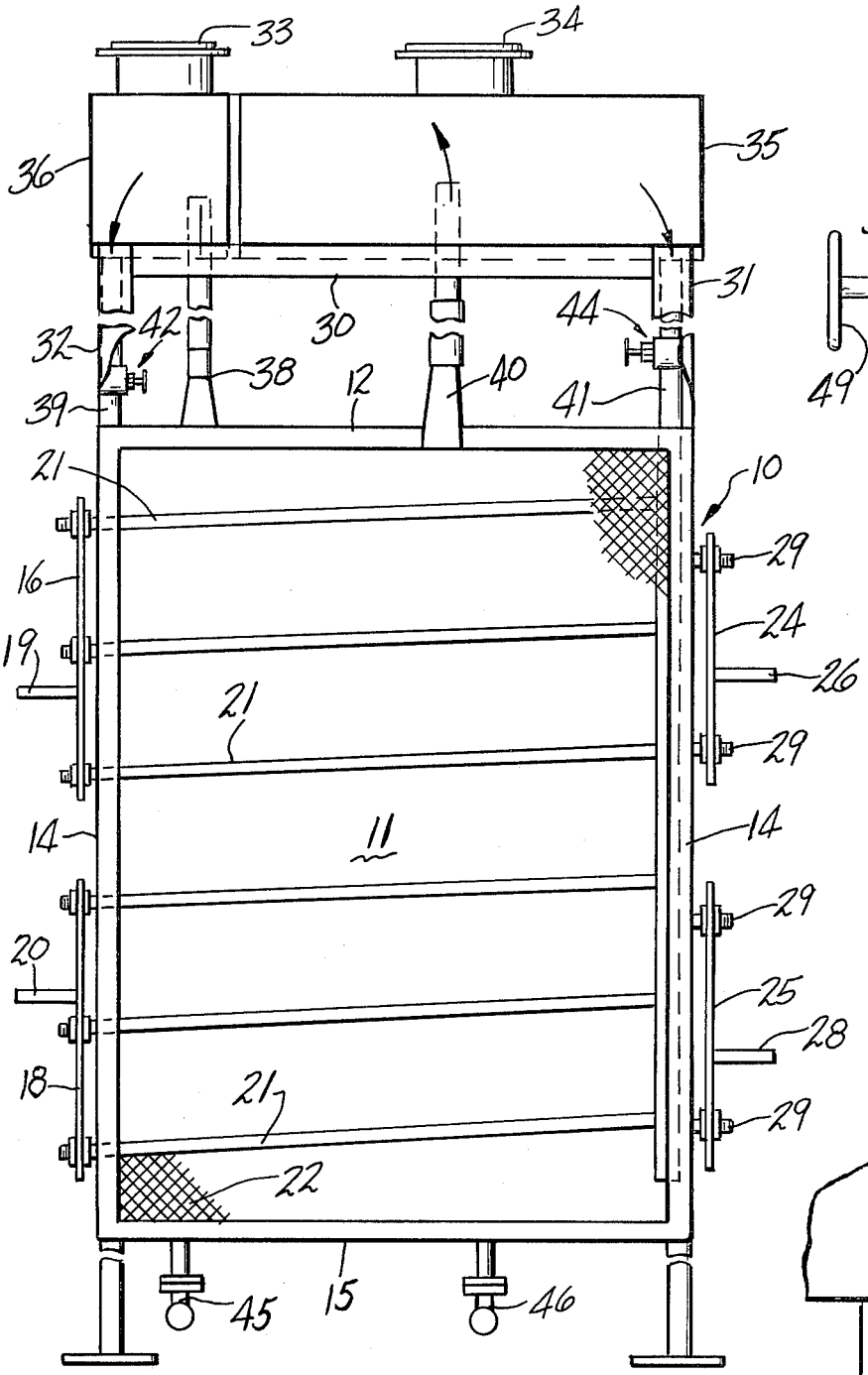
FIG. 1 is a side elevational view of a filter press membrane cell with the cell frame broken away to show the anolyte and catholyte disengagers mounted atop the electrode frame and connecting to the alternating cathode and anode electrodes via risers and downcomers having the anode as the electrode closest to the viewer.

Referring to FIG. 1 there is shown in side elevation a view of a typical electrochemical cell 10 looking at an anode frame 11 as the closest electrode to the viewer. Frame 11 is seen comprising a top channel 12, two opposing side channels 14, and a bottom channel 15. Upper anode distributor 16 and lower anode distributor 18 are appropriately joined to upper anode terminal 19 and lower anode terminal 20, respectively. Anode conductor rods 21 extend into the anode compartment formed between the opposing anode surfaces 22, only one of which is shown. On the opposing side of the cell 10 is shown the upper cathode collector 24 and lower cathode collector 25 appropriately connected to the upper cathode terminal 26 and the lower cathode terminal 28, respectively. Extending inwardly into the cathode compartment (not shown) is a plurality of cathode conductor rods 29, appropriately secured to the upper cathode collector 24 and the lower cathode collector 25.

Shown mounted to the top of cell 10 via disengager horizontal support 30, disengager vertical supports 31, 32, and cell horizontal frame support beams (not shown) are the anolyte disengager 35 and catholyte disengager 36. A plurality of fluid flow conduits connect the disengagers to their appropriate electrodes. Catholyte riser or first flow conduit 38 carries the catholyte fluid up into the disengager from the cathode frame (not shown), while the cathode downcomer or second flow conduit 39 returns the catholyte fluid into the cathode frame. Similarly, the anolyte disengager 35 is connected to the anode frame 11 via an anolyte riser or first flow conduit 40 and an anolyte downcomer or second flow conduit 41. Restrictor means 42 and 44, in the forms of valves, are shown in the catholyte downcomer line 39 and the anolyte downcomer line 41, respectively. These will be described in further detail hereafter.

The cell 10 also has a catholyte drain 46 in the bottom of each cathode (not shown) and an anolyte drain 45 projecting from the underside of bottom channel 15 of each anode frame 11 of the cell. The cell 10 has been described only generally since the structure and the function of its central components are well known to one skilled in the art. A more detailed and thorough description of the filter press membrane cell 10 is found in U.S. patent application Ser. No. 128,684, filed Mar. 10, 1980, assigned to the assignee of the present invention, and hereinafter specifically incorporated by reference in pertinent part insofar as it is consistent with the instant disclosure.

Figure 2:
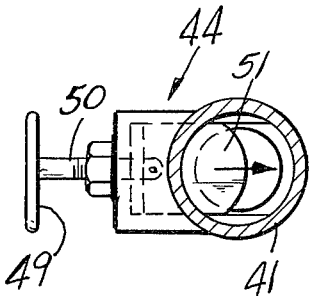
FIG. 2 is an enlarged top plan view of a downcomer leading from the anolyte disengager to an anode with a gate valve provided to restrict the anolyte flow.

Referring now to FIG. 2, there is shown a top plan view of the anolyte restrictor means 44 mounted to the anolyte downcomer 41. As can be seen, restrictor means 44 is in the form of a gate valve having a handle 49 which is appropriately connected to a threaded spool 50 that connects to the gate 51. As can be seen, this type of a valve is commonly utilized in liquid flow lines so that the handle 49 can be turned to cause the spool 50 to move inwardly, forcing the gate 51 to restrict the opening within the downcomer 41 to decrease the flow rate of anolyte fluid through the disengager 35.

Figure 3:
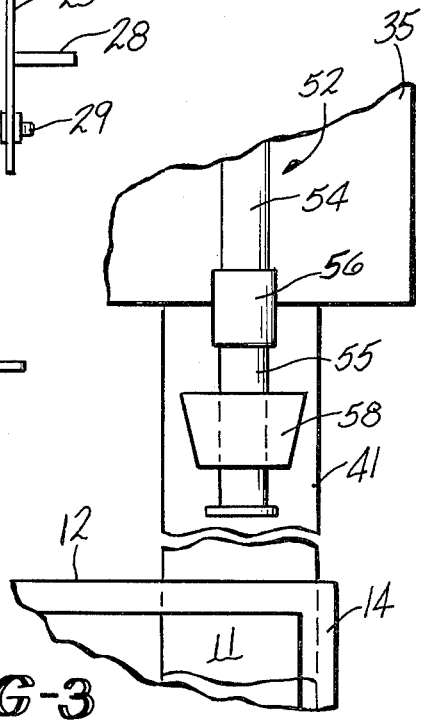
FIG. 3 is an enlarged side elevational view of an alternate embodiment partially diagrammatically showing restrictor apparatus placed within the downcomer to restrict the anolyte flow.

Since it has been found that the foam level in the anolyte disengager 35 can be appreciably reduced by reducing the recirculation flow rate, alternate flow restrictor means have been attempted. Such apparatus is shown in FIG. 3 wherein a portion of the anolyte disengager 35 is shown connected to top channel 12 of anode frame 11 by the anolyte downcomer 41. In this embodiment fresh electrolyte feed line 52 is shown extending from within the disengager 35 towards the anode frame 11. The feed line 52 is comprised of a first part 54 which is connected to the electrolyte manifold (not shown) and a second portion 55. The first portion 54 and the second portion 55 are connected by an appropriate coupling 56. A restrictor in the form of the arcuately surfaced or frusto-conical plug 58 is fastened about the second portion of the feed line 55. If necessary, plug 58 can be replaced with a larger or smaller diameter restrictor plug, dependent upon the needs of the operating situation, to achieve the optimum anolyte recirculation versus the desired foaming level. Plug 58 effectively reduces the cross-sectional area within the downcomer 41 available for anolyte fluid recirculation. This decreases the anolyte flow through the disengager, effectively extending the amount of time the fluid must spend in the disengager and thereby maximizing the chlorine gas separation from the fluid.

While the instant invention has been discussed only in terms of the anolyte disengager 35 and the anolyte downcomer or return line 41, it should be noted that the foaming level is also an operational problem in the catholyte disengager 36. Excessive foaming within the catholyte disengager 36 reduces the efficiency of the gas-liquid separation that occurs therein during operation. Accordingly, a similar type of restrictor means to that shown in detail in either FIGS. 2 or 3 could be employed in the catholyte downcomer line 39 as indicated in FIG. 1.

In order to exemplify the results achieved, the following Example is provided without any intent to limit the scope of the instant invention to the discussion therein. The Example is intended to illustrate the effect on the foaming level achieved in the anolyte disengager by restricting the flow in one downcomer. It should be noted again, that similar results will be obtained from the method described on the foaming level in the catholyte disengager.

EXAMPLE

A monopolar filter press cell was fabricated having an anode sandwiched between two end cathodes, the anode and each cathode being separated by an ion-selective permeable membrane. The anode was 84 inches high, 60 inches wide, and 1½ inches thick. The individual anode frame was constructed of ¼ inch thick titanium in the side frame members with channels having 1½ inch webs and 1 inch opposing sides. Both sides of the anode were faced with activated titanium mesh. The top of the anode frame comprised a top channel constructed of ⅛ inch thick titanium with a 1½ inch by 3 inch deep channel. The cathodes were of the same dimensions and were clamped on opposing sides of each anode frame. The individual cathode frames were constructed from nickel.

Six ¾ inch diameter titanium clad copper conductor rods were welded to the anode mesh, internally extending through one of the anode side frame member channels toward the exterior of the opposing side. A 2 inch Schedule 10 pipe was flattened to 1 inch, except for approximately 6 inches which was intended to extend above the top channels of all of the electrode frames. The flattened portion was then inserted vertically through the top channel of each electrode frame, adjacent to the channel frame on the opposing side from which the six titanium clad copper rods were inserted into the electrode. This Schedule 10 pipe or downcomer, was seal welded at the top and extended to within approximately 6 inches of the bottom of the electrode. This length of the downcomer was approximately 90 to 95% of the height of each electrode. The cathode frames were generally constructed similarly to the anode frames except that the titanium mesh was replaced by nickel and was placed on only one surface. Additionally, the conductor rods extended into the electrode compartment from the opposite side to that from which the anode conductor rods entered the electrode.

The gas liquid disengagers were generally rectangular in size, each being 15 inches high and 4 inches wide. The anolyte disengager for the chlorine was 32 inches long and the catholyte disengager for the hydrogen was approximately 20 inches long. The bottom of the anolyte disengager was 28.75 inches above the top of the cell and the catholyte disengager was positioned 15 inches above the top of the cell. Both the riser pipes and the downcomer pipes were 2 inch Schedule 10 pipes with hose couplings. The riser pipe generally extended about 6 inches above the bottom of the disengager. The anolyte disengager had a capacity of approximately 8.5 gallons, while the catholyte disengager had a capacity of approximately 5.2 gallons.

Two tests were conducted to measure the level of foam within the anolyte disengager. The first test ($T_1$) was conducted shortly after start-up of the filter press membrane electrolytic cell and the second test ($T_2$) was conducted approximately four months later after the cell had sufficient operating time to stabilize. An ultrasonic flow meter was utilized on the second flow conduit or downcomer leading from the anolyte disengager back down into the anode to measure the flow rate. The flow rate was calculated in gallons per minute (gpm) utilizing the ultrasonic flow meter reading times a predetermined calibration factor times the flow area of the conduit. During the first test ($T_1$), a current of 12.0KA (2KA/M$^2$), with an anolyte fluid of 20% NaCl at 90° C. and a catholyte fluid of 40% NaOH at 92° C. was utilized. A return flow of electrolyte fluid from the anolyte disengager into the anode was measured varying between a low of 16 gpm to a high of 45 gpm. During the second test ($T_2$) the same current level and anolyte and catholyte fluid compositions were utilized. However, the anolyte temperature was recorded as 89° C. and the catholyte temperature was recorded as 90° C. A return flow through the second flow conduit was generated varying between approximately 5.6 gpm and 48 gpm depending on the degree of restriction in the downcomer or second flow conduit.

Figure 4:
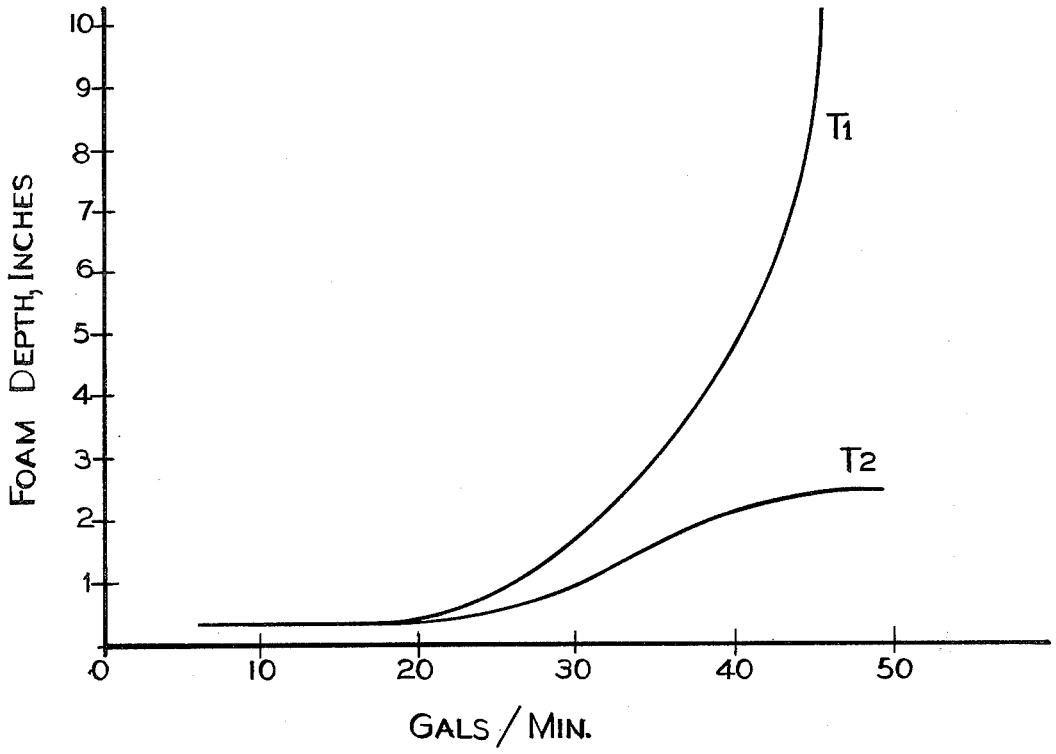
FIG. 4 is a graph depicting the results of two tests conducted in an anolyte disengager to measure the foam depth in inches as influenced by the electrolyte recirculation flow rate calculated in gallons per minute.

It should be noted that these tests were conducted in a filter press membrane electrolytic cell which utilized a single double faced anode sandwiched between two half-faced cathodes. Thus, the anolyte disengager had a single riser or first flow conduit and a single downcomer or a second flow conduit connected in fluid flow communication with the anode. Similarly, the catholyte disengager was connected to both cathodes and therefore had two risers or first flow conduits and two downcomers or second flow conduits, thereby establishing the fluid flow communication. As shown in FIG. 4 by the graphs $T_1$ and $T_2$ which plot the data in Tables I and II, it was found that by restricting the electrolyte return flow through the second flow conduit, the foaming level in the anolyte disengager 35 could be decreased.

The objective of the design of the cell in the present Example was to obtain a maximum flow rate of electrolyte fluid between the disengagers and their respective electrodes without exceeding the capacity of the disengagers. This effectively prevented foam from overflowing and blowing out of the gas flow conduit which creates undesireable pressure surges in the cell. The liquid level within the disengagers also had to be kept at a sufficiently deep level to prevent a vortex from forming that would suck the electrolytic product gas down into the electrode while the liquid electrolyte was recycled through the downcomer or second flow conduit from the disengager back to the electrode. Thus, the overall purpose of designing an electrolytic cell which utilized as narrow a disengager as possible without exceeding the capacity of the disengager could be accomplished by use of any variable restrictor apparatus in the second flow conduit to prevent blow-over of foam into the gas flow conduit during operation.

As can be seen from the data, the designed height of the disengager is a function of the height of foam that occurs within the disengager during operation. Within physical limits, the variable flow restrictor in the second flow conduit permits the maximum flow rate of electrolyte to be obtained during recirculation without having the foaming level exceed the capacity of the disengager.

TABLE I (T1)

| Time | Liquid Level (Inches) | Foam Level (Inches) | Foam Depth (Inches) | Flow Meter | Flow Rate (GPM) |
|---|---|---|---|---|---|
| $T_0$ | 1.5 | 12.0 | 10.5 | 2.3 | 45 |
| $T_0$ + 31 min. | 2.5 | 12.0 | 9.5 | 2.3 | 45 |
| $T_0$ + 36 min. | 2.5 | 10.0 | 7.5 | 2.2 | 43 |
| $T_0$ + 38 min. | 3.5 | 9.5 | 6.0 | 2.2 | 41 |
| $T_0$ + 48 min. | 4.5 | 9.5 | 5.0 | 2.1 | 43 |
| $T_0$ + 58 min. | 2.5 | 10.5 | 8.0 | 2.2 | 45 |
| $T_0$ + 60 min. | 1.5 | 12.0 | 10.5 | 2.3 | 41 |
| $T_0$ + 1 hr. 4 min. | 3.5 | 9.0 | 5.5 | 2.1 | 41 |
| $T_0$ + 1 hr. 6 min. | 4.0 | 9.5 | 5.5 | 2.1 | 41 |
| $T_0$ + 1 hr. 8 min. | 4.5 | 9.5 | 5.0 | 2.1 | 41 |
| $T_0$ + 1 hr. 13 min. | 6.0 | 10.5 | 4.5 | 2.1 | 41 |
| $T_0$ + 1 hr. 14 min. | 3.0 | 8.0 | 5.0 | 2.0 | 39 |
| $T_0$ + 1 hr. 19 min. | 4.0 | 7.0 | 3.0 | 1.8 | 35 |
| $T_0$ + 1 hr. 21 min. | 5.0 | 7.5 | 2.5 | 1.5 | 29 |
| $T_0$ + 1 hr. 30 min. | 5.0 | 6.0 | 1.0 | 1.3 | 25 |
| $T_0$ + 1 hr. 41 min. | 5.0 | 6.0 | 1.0 | 1.0 | 19.6 |
| $T_0$ + 1 hr. 46 min. | 5.0 | 5.5 | .5 | 1.0 | 19.6 |
| $T_0$ + 1 hr. 54 min. | 5.0 | 5.5 | .5 | 0.9 | 19 |
| $T_0$ + 2 hr. 6 min. | 6.0 | 6.5 | .5 | 0.9 | 18 |
| $T_0$ + 2 hr. 21 min. | 6.0 | 6.5 | .5 | 0.9 | 18 |
| $T_0$ + 3 hr. 56 min. | 5.0 | 5.5 | .5 | 0.8 | 16 |

TABLE II (T2)

| Time | Liquid Level (Inches) | Foam Level (Inches) | Foam Depth (Inches) | Flow Meter | Flow Rate (GPM) |
|---|---|---|---|---|---|
| $T_0$ | 5.0 | 5.375 | 0.375 | 1.8 | 14 |
| $T_0$ + 11 min. | 5.25 | 6.0 | 0.75 | 3.1 | 25 |
| $T_0$ + 15 min. | 4.0 | 5.0 | 1.0 | 3.9 | 31 |
| $T_0$ + 18 min. | 4.5 | 6.0 | 1.5 | 4.3 | 34 |
| $T_0$ + 20 min. | 5.0 | 7.0 | 2.0 | 4.8 | 38 |
| $T_0$ + 23 min. | 4.0 | 6.0 | 2.0 | 5.1 | 41 |
| $T_0$ + 29 min. | 4.5 | 6.5 | 2.0 | 5.3 | 42 |
| $T_0$ + 31 min. | 3.5 | 5.75 | 2.25 | 5.5 | 44 |
| $T_0$ + 33 min. | 3.0 | 5.5 | 2.5 | 5.7 | 45 |
| $T_0$ + 34 min. | 4.0 | 6.0 | 2.0 | 5.9 | 47 |
| $T_0$ + 35 min. | 4.5 | 6.5 | 2.0 | 5.9 | 47 |
| $T_0$ + 37 min. | 5.0 | 7.0 | 2.0 | 5.9 | 47 |

In operation, appropriate electrolyte fluid is circulated through the anode and cathode compartments of the anode and cathode frames which are arranged in alternating manner in the electrochemical cell 10. The electrolyte fluid is circulated so that from the cathode frame (not shown) the electrolyte fluid with entrained hydrogen gas and the appropriate caustic or alkali metal hydroxide rise up through riser 38 into the catholyte disengager 36. Within the disengager the entrained hydrogen gas separates from the electrolyte fluid, commonly known as a catholyte, and exits the catholyte disengager 36 through an appropriate conduit 33 to a gas handling system. The catholyte is recycled into the cathode frame by passing through a downcomer 32 on which a catholyte restrictor means 42 is appropriately mounted.

Similarly, electrolyte is permitted to circulate into the anolyte disengager 35 by rising up the anolyte riser 40 into the disengager 35 where the entrained chlorine gas bubbles are permitted to separate from the foaming anolyte fluid. The chlorine gas then passes into an appropriate conduit 34 and into the chlorine gas handling system. The anolyte fluid is recirculated down into each anode frame 11 via the anolyte downcomer 41. Appropriately mounted in the downcomer 41 is an anolyte restrictor means 44.

Electrical power is supplied to the cell 10 from an external power source. The current is conducted into each anode framell via the upper and lower anode terminals 19 and 20, the upper and lower anode collectors 16 and 18, and the anode conductor rods 21 to supply the energy necessary for electrolysis. Similarly, for each cathode frame the current is conducted through the compartment formed by the frame and the opposing cathode surfaces via the cathode conductor rods, the upper and lower cathode collectors 24 and 25, and the upper and lower cathode terminals 26 and 28 to supply the energy necessary to promote the electrolytic reactions within the cell 10. While the electrical current is thus conducted through the cell 10, the appropriate electrolyte fluid is circulated through each anode and cathode frame as described above.

Both the catholyte restrictor means 42 and the anolyte restrictor means 44 operate to control the amount of cross-sectional area available for electrolyte fluid flow in their respective downcomer or return lines 39 and 41. This varying of the cross-sectional area within each downcomer controls the recirculation flow rate of the electrolyte between the appropriate disengager and electrode. The level of foaming that occurs within each disengager is a direct function of the flow rate of the catholyte fluid or the anolyte fluid through the appropriate disengager. By restricting the cross-sectional area in the appropriate downcomer line, the recirculation flow rate is decreased so that the foam level is decreased in the anolyte or catholyte fluid, as appropriate. Thus, by varying the cross-sectional area available for flow of both the anolyte downcomer 41 and the catholyte downcomer 39, the level of foam build-up in the appropriate disengager can be controlled despite variations in operating conditions that otherwise may negatively affect the operating efficiency of the electrochemical cell 10.

While the preferred structure in which the principles of the present invention have been incorporated is shown and described above, it is to be understood that the invention is not to be limited to the particular details thus presented, but in fact, widely different means may be employed in the practice of the broader aspects of this invention. For example either one or both of the catholyte restrictor means 42 and anolyte restrictor means 44 may be coupled to actuator apparatus which responds to sensing apparatus that monitors one or more operating conditions within the cell 10. The actuator apparatus could then automatically adjust the appropriate restrictor means to correct the sensed condition within the cell. Also, although the apparatus has been described in the context of a chlor-alkali cell utilizing a salt brine and sodium base caustic, it is to be understood that the invention is equally well adaptable to cells producing potassium hydroxide as the caustic.

Additionally, the method disclosed herein should be understood in its broadest sense to be applicable to all types of electrolytic cells wherein gas-liquid separators or disengagers are employed to separate entrained gases from electrolytes or other fluids. This invention specifically is applicable to cells employing internal separation or disengaging of the gases beneath the cell's cover within the cell's containment area or to cells employing external separators or disengagers such as the type illustrated herein where the fluids are circulated from the individual electrodes to the disengagers which are mounted separately and outside of the main cell's structure and the individual electrodes. In cells of the former type electrolyte fluids generally are circulated along flow paths between the electrodes and the gas separation area which is usually adjacent the cell's cover. The electrolyte fluid follows flow paths similar to that shown in U.S. Pat. No. 3,898,149 in FIG. 6 wherein the electrolyte passes between the containing tank walls and the intermeshed anodes and cathodes mounted to their respective anode plate and cathode plate as the electrolyte flows along the second flow path from the gas separation area back to the electrodes. Placing restrictors in the second flow path to selectively control the flow rate of the electrolyte fluids along the second flow path and therefore through the gas separation area will effectively control the level of foaming within the gas separation area to obtain optimum separation of the entrained gas therefrom.

The scope of the appended claims is intended to encompass all obvious changes in the details, materials and arrangements of parts which will occur to one of skill in the art upon a reading of the disclosure.

Having thus described the invention, what is claimed is:

1. A method for controlling the level of foaming in the gas separation area of an electrolytic cell having at least a first flow path and a second flow path between each electrode and the gas separation area thereby establishing each electrode and the gas separation area in fluid flow communication, the gas separation area further having at least one gas flow conduit in communication therewith to transport gaseous electrolytic product to processing apparatus, the method comprising the steps of:

(a) circulating electrolyte fluids along the first flow path from each electrode to the gas separation area;
(b) circulating electrolyte fluids through the gas separation area;
(c) circulating electrolyte fluids along the second flow path from the gas separation area back to each electrode; and
(d) selectively controlling the flow rate of the electrolyte fluids along the second flow path to thereby control the flow rate of electrolyte fluids through the gas separation area so that the level of foaming within the gas separation area is controlled at a level that prevents the blow-over of foam into the gas flow conduit and still permits separation of entrained gas from the electrolyte fluids within the gas separation area.

2. A method for controlling the level of foaming in the electrolyte fluids in the gas separation area of an electrolytic cell having at least a first flow path and a second flow path between each cathode and the gas separation area thereby establishing fluid flow communication between each cathode and the gas separation area, the gas separation area further having at least one gas flow conduit in communication therewith to transport gaseous electrolytic product to processing apparatus, the method comprising the steps of:

(a) circulating electrolyte fluid along the first flow path from each cathode to the gas separation area;
(b) circulating electrolyte fluid through the gas separation area to permit entrained gas to separate therefrom;
(c) circulating electrolyte fluid along the second flow path from the gas separation area to each cathode; and
(d) selectively controlling the flow rate of the electrolyte fluid along the second flow path in such a manner that the level of foaming within the gas separation area is controlled at a level to prevent the blow-over of foam into the gas flow conduit and still permit separation of entrained gas from the electrolyte fluid within the gas separation area.

3. The method of controlling the level of foaming in the gas separation area according to claim 2 further comprising:

selectively varying the cross-sectional area available for fluid flow along the second flow path between the gas separation area and each cathode to thereby control the flow rate of electrolyte fluid through the gas separation area.

4. A method for controlling the level of foaming in the electrolyte fluids in the gas separation area of an electrolytic cell having a first flow path and a second flow path between each anode and the gas separation area thereby establishing fluid flow communication between each anode and the gas separation area, the method comprising the steps of:

(a) circulating electrolyte fluid along the first flow path from each anode to the gas separation area;
(b) circulating electrolyte fluid through the gas separation area to permit entrained gas to separate therefrom;
(c) circulating electrolyte fluid along the second flow path from the gas separation area to each anode; and
(d) selectively controlling the flow rate of the electrolyte fluid along the second flow path in such a manner that the level of foaming within the gas separation area is controlled at a level to prevent the blow-over of foam into the gas flow conduit and still permit separation of entrained gas from the electrolyte fluid within the gas separation area.

5. The method of controlling the level of foaming in the gas separation area according to claim 4 further comprising:

selectively varying the cross-sectional area available for fluid flow along the second flow path between the gas separation area and each anode to thereby control the flow rate of electrolyte fluid through the gas separation area.

6. A method of controlling the level of foaming in the anolyte disengager in an electrolytic filter press membrane cell having at least a first flow conduit and a second flow conduit in fluid flow communication with each anode and the anolyte disengager, the anolyte disengager further having a gas flow conduit to transport gaseous electrolytic product to processing apparatus, the method comprising the steps of:

(a) circulating anolyte fluids along a predetermined path from each anode to the anolyte disengager and back to each anode; and (b) selectively controlling the flow rate of anolyte fluid through the anolyte disengager to thereby control the level of foam within the anolyte fluids at a level to prevent the blow-over of foam into the gas flow conduit and permit separation of entrained gas from the anolyte fluid within the anolyte disengager.

7. The method of controlling the level of foaming in the anolyte disengager according to claim 6 further comprising:

selectively controlling the flow rate of anolyte fluid as the anolyte fluid flows between the anolyte disengager and each anode along its predetermined path.

8. The method of controlling the level of foaming in the anolyte disengager according to claim 7 further comprising:

selectively varying the cross-sectional area available for fluid flow within each second flow conduit between the anolyte disengager and each anode to thereby control the flow rate of anolyte fluid through the anolyte disengager to each anode.

9. A method for controlling the level of foaming in the catholyte disengager in an electrolytic filter press membrane cell having at least a first flow conduit and a second flow conduit in fluid flow communication with each cathode and the catholyte disengager, the disengager further having a gas flow conduit to transport the gaseous electrolytic product to processing apparatus, the method comprising the steps of:

(a) circulating catholyte fluid along a predetermined path from each cathode to the catholyte disengager and back to each cathode; and (b) selectively controlling the flow rate of catholyte fluid through the catholyte disengager to thereby control the level of foam within the catholyte fluid at a level to prevent the blow-over of foam into the gas flow conduit and permit separation of entrained gas from the catholyte fluid within the catholyte disengager.

10. The method of controlling the level of foaming in the catholyte disengager according to claim 9 further comprising:

selectively controlling the flow rate of catholyte fluid as the catholyte fluid flows between the catholyte disengager and each cathode along its predetermined path.

11. The method of controlling the level of foaming in the catholyte disengager according to claim 10 further comprising:

selectively varying the cross-sectional area available for fluid flow within the second flow conduit between the catholyte disengager and each cathode to thereby control the flow rate of catholyte fluid through the catholyte disengager to each cathode.

12. A method for controlling the level of foaming in the anolyte and catholyte disengagers in an electrolytic cell having at least a first flow conduit and a second flow conduit in fluid flow communication with each electrode and the appropriate disengager, the disengagers further having gas flow conduits to transport the gaseous electrolytic product to processing apparatus, the method comprising the steps of:

(a) circulating electrolyte fluid from each electrode through a first flow conduit to the appropriate disengager;

(b) circulating the electrolyte fluids through each disengager to permit entrained gas to separate therefrom;

(c) circulating the electrolyte fluids from the appropriate disengagers to the electrodes via second fluid flow conduits; and (d) selectively controlling the flow rate of the electrolyte fluids through the second fluid flow conduits to thereby control the flow rate of electrolyte fluids through the anolyte and catholyte disengagers so that the level of foaming within each disengager is controlled at a level to prevent foam blow-over into the gas flow conduits and permit separation of entrained gas from the electrolyte fluids contained within the disengagers.

* * * * *